United States Patent [19]

Brueckner et al.

[11] 4,166,992

[45] Sep. 4, 1979

[54] SYMMETRICAL STRUCTURE FOR SHUNT CONTROLLED REGULATED TRANSFORMER

[75] Inventors: Karl H. Brueckner; Charles A. Farel; Paul Y. Hu, all of Boulder, Colo.

[73] Assignee: International Business Machines Corporation, Armonk, N.Y.

[21] Appl. No.: 821,892

[22] Filed: Aug. 4, 1977

[51] Int. Cl.[2] ..... H01P 27/30

[52] U.S. Cl. ..... 336/155

[58] Field of Search ..... 323/6, 44 R, 56, 89 C, 323/48; 336/155, 160, 212, 214, 215

[56] References Cited

U.S. PATENT DOCUMENTS

| | | | |
|---|---|---|---|
| 1,376,978 | 5/1921 | Stoekle | 336/215 X |
| 1,614,254 | 1/1927 | Persons | 361/56 X |
| 2,245,192 | 6/1941 | Gugel | 323/44 R |
| 2,425,622 | 8/1947 | Kronmiller | 336/215 |
| 2,738,458 | 3/1956 | Walsh | 336/160 X |
| 2,976,478 | 3/1961 | Aske | 323/89 C |
| 3,087,108 | 4/1963 | Toffolo et al. | 323/56 |
| 3,622,868 | 11/1971 | Todt | 323/89 C |
| 4,032,840 | 6/1977 | Lebedev et al. | 323/48 |

FOREIGN PATENT DOCUMENTS

| | | | |
|---|---|---|---|
| 1286583 | 1/1962 | France | 323/89 C |

*Primary Examiner*—A. D. Pellinen

*Attorney, Agent, or Firm*—James A. Pershon; Joscelyn G. Cockburn

[57] ABSTRACT

The output voltage of a flux controlled transformer is regulated by controlling the magnetic flux flow in the main core of the transformer. This regulation is achieved by a magnetic structure which includes a main core with primary and secondary coils thereon; shunt cores symmetrically situated about the main core; and leakage paths symmetrically positioned about the main core so as to interconnect the main and shunt cores. In one configuration the leakage paths include magnetic laminations which are positioned perpendicular to the magnetic laminations which form the main and shunt cores. In another configuration the magnetic laminations are arranged in a trapezoidal configuration.

5 Claims, 10 Drawing Figures

FIG. 1
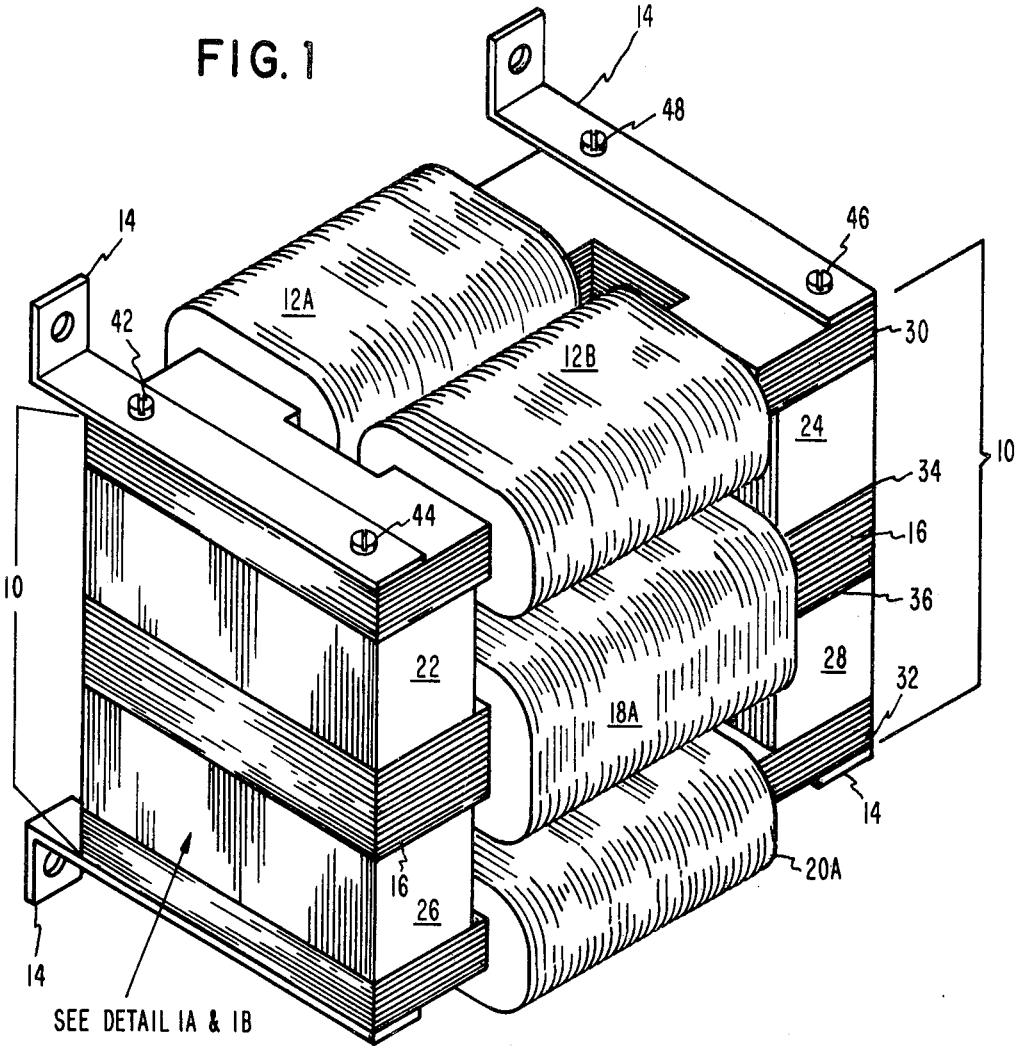
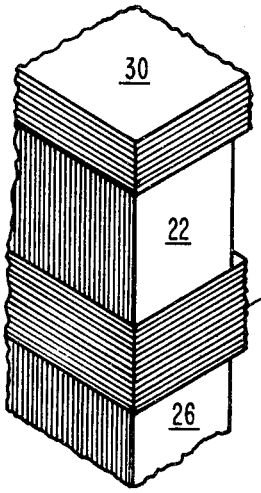
FIG. 1A
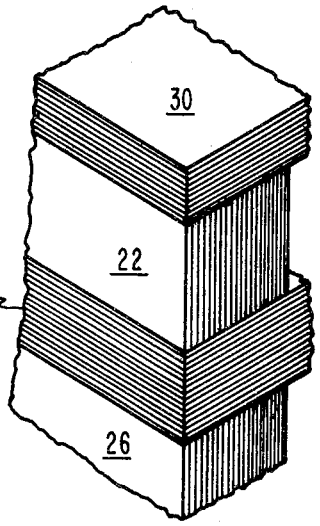
FIG. 1B

SYMMETRICAL STRUCTURE FOR SHUNT CONTROLLED REGULATED TRANSFORMER

CROSS-REFERENCE TO RELATED APPLICATION

The present application is related to application Ser. No. 821,893, filed concurrently herewith and assigned to the same assignee as the present invention.

BACKGROUND OF THE INVENTION

1. Field of the Invention

This invention relates to transformers and more particularly to voltage regulating transformer.

2. Description of the Prior Art

The principle of varying the voltage of a transformer by controlling its leakage flux is broadly old in the art. For example, in U.S. Pat. No. 2,245,192 the output voltage of a transformer is varied by varying the reluctance of both the main flux and leakage flux paths of the transformer. To effectuate this control, parallel flux paths are fabricated in the main core of the transformer. Basically, the transformer has a non-conventional structure. Primary and secondary windings are seated on the main core, while saturating windings are seated on the parallel flux paths of the main core. An auxiliary core carrying saturating windings is positioned in shunt relationship and is encompassed by the main core. The patent does not disclose how the auxiliary core is supported relative to the main core. However, one would imagine that a support means of some kind is necessary to support the auxiliary core since this core is not in contact with the main core. Also the setting of the air gap and/or air gaps between the main core and the auxillary core is not disclosed. However, due to the high reluctance characteristics of air to the flow of magnetic flux, unless the air gap and/or air gaps are within a certain specification, the effect of the auxiliary core on the main core is negligible. In fact, if the setting of the air gap and/or gaps is too wide, then the structure will no longer function as a voltage regulator since the leakage flux which is necessary to achieve voltage regulation will confine itself to flow in the main core rather than shunting to the auxiliary core.

In an attempt to ward off the non-regulating dilemma, the main core is fabricated with parallel flux paths. However, the incorporation of parallel flux paths tends to increase the complexity of the transformer. Due to the complexity of the magnetic structure and the need for the critical setting of the air gap and/or air gaps, the overall cost of the transformer tends to increase.

Another obvious limitation is that the transformer does not readily fit into a compact machine where space is limited.

Various attempts have been made in the prior art to design sturdy, rugged and compact voltage regulating transformers. In U.S. Pat. No. 1,614,254, a regulating transformer which regulates the voltage across a telephone receiver is disclosed. The transformer consists of a centrally located plate made of a permalloy material with two core sections arranged in space relationship but abutting said plate. Control windings are seated on each core section. The magnetic characteristic of the plate is such that, when the voltage across the receiver is within its predetermined range, the reluctance of the plate is minimal. By positioning the winding on the cores to be in series, the reluctance of the transformer is such that shunt loss is minimal. Whenever the voltage across the telephone lines rises the flux through the transformer increases. This increases the permeability of the plate until a maximum value is reached. With the permeability of the core less than maximum the flux is forced to follow the individual cores. However since the coils are connected in series in opposing relationship the flux produced by the current in one winding tends to neutralize the flux produced by the current in the other winding. The net result is that more current flows from the telephone line into the transformer. This in turn increases the reluctance of the plate. This process continues until a point is reached above which the voltage across the terminals of the telephone receiver cannot be increased.

The limitation on the above device is that the degree of voltage regulation is limited (i.e. narrow). This limitation stems from the fact that the voltage regulation is dependent on a fixed variable (i.e. the magnetic characteristics of the treated plate.) The device is not suitable for use in an environment where the voltage regulating range is variable.

BRIEF DESCRIPTION OF THE DRAWINGS

FIG. 1 shows a pictorial view of the transformer embodying the present invention.

FIG. 1A shows one arrangement for orientating the bottleneck laminations.

FIG. 1B shows another arrangement for orientating the bottleneck orientations.

SUMMARY OF THE INVENTION

Figure 2:
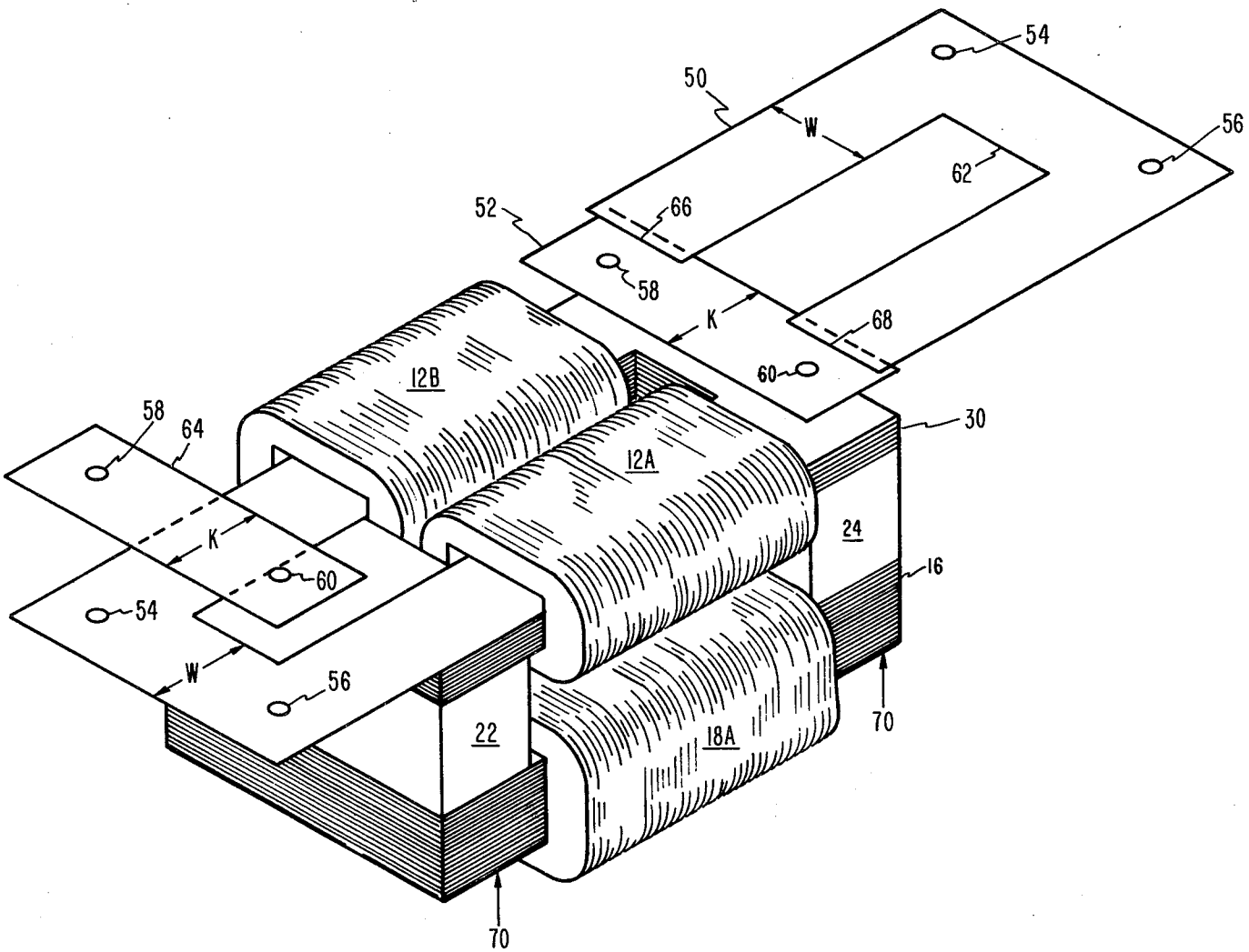
FIG. 2 shows building elements of the transformer and is helpful in understanding the process used to fabricate the transformer.

The present invention contemplates a symmetrical transformer having a main magnetic core with a primary coil and a secondary coil thereon. Magnetic flux leakage paths are positioned about and in contact with the main core. A pair of shunt cores is then connected to the leakage path. Control coils are seated on the shunt cores. By varying the current flow to the controlled coil the output regulated voltages of the main transformer are controlled.

In one feature of the invention the transformer cores and leakage paths are fabricated from laminations. However, the laminations of the leakage paths are arranged perpendicular to the laminations of the main and shunt cores, the purpose of which is to facilitate the flow of magnetic flux from the main to the shunt core.

In another feature of the invention the leakage paths are fabricated with a trapezoidal geometric shape.

In still another feature of the invention the height of the main core is approximately equivalent to two and one half times the width of the lamination.

In yet another feature of the invention the controlled coil is seated on the leakage paths of the transformer. In this configuration the shunt core only acts as a flux return path for the symmetrical transformer.

The foregoing and other features, and advantages of the invention will be apparent from the following more particular description of a preferred embodiment of the invention, as illustrated in the accompanying drawings.

DESCRIPTION OF THE PREFERRED EMBODIMENT

Referring now to FIG. 1 a pictorial view of the regulating transformer which incorporates the present invention is shown. This transformer includes magnetic structure 10, a plurality of coils 12A, 12B, 18A and 20A which are placed on the magnetic structure, and mounting means 14 which is attached to the magnetic structure.

The magnetic structure is analogous to an electric circuit in that flux is created at one section of the magnetic structure and transferred throughout the structure to generate a regulated voltage at another section of the structure. The magnetic structure includes a main magnetic core 16. The magnetic core is manufactured from a plurality of U-I laminations. The number of laminations and the height of the main core is dependent upon the power requirements of the transformer. As will be explained hereinafter the characteristic of the U-I laminations and the process for manufacturing the main core will be discussed. Suffice it to say that the main core has a substantially rectangular shape with a void or rectangular opening in the central portion of the core. This void is necessary to accommodate a primary winding and a secondary winding which will be discussed shortly. Primary winding 18A hereinafter called primary coil 18A is seated on one leg of the main core. Similarly, secondary winding hereinafter called secondary coil (not shown) is seated on the opposite leg of the main magnetic core across from the primary coil. Input power to the transformer is supplied via electrical conductors (not shown) which are connected to the primary coil. Likewise, the regulated output voltage is taken from the secondary coil via electrical conductors (not shown). This output voltage which is taken from the secondary coil is regulated and then distributed for use. The secondary coil may have multiplicity of windings depending on the various number of output voltage required by the application.

It is worthwhile noting at this stage of the description that the range over which the output current is regulated is significantly wider than was heretofore possible in a transformer which is manufactured in accordance with the teaching of the present invention. This improved range of control stems from the fact that the main magnetic core is controlled by leakage flux paths 22, 24, 26 and 28, respectively. The leakage paths are hereinafter called bottlenecks. As will be discussed shortly the function of the bottlenecks are to conduct or direct the flow of flux from the main core to the shunt cores 30 and 32 respectively.

Since the bottleneck is the means of conducting flux away from the main core it is necessary that a magnetic material which provides maximum magnetic permeability, maximum magnetic saturation and low core loss be used to fabricate the bottleneck. A magnetic material having such characteristics is, for example, soft magnetic iron. This material may be fabricated in solid bars or laminations depending on the frequency of AC voltage, and/or eddy current requirements. In addition to soft magnetic iron the bottleneck may be fabricated from ferrite bars.

Still referring to FIG. 1 the bottlenecks are arranged in pairs for example, bottleneck 22 and 24 form the pair which is seated on the upper surface 34 of the main core. Likewise, bottlenecks 26 and 28, respectively, form another pair which is seated on lower surface 36 of the main core. As is evident from the figure the bottlenecks are connected to the main core.

Although the bottleneck may be fabricated from solid bars, in the preferred embodiment the bottlenecks are fabricated from a plurality of I-shaped laminations.

Seated on top of and in intimate contact with bottlenecks 22 and 24 is shunt core 30. Shunt core 30 is the flux leakage path for the transformer. Stated another way shunt core 30 functions as the return path for flux which is generated in the upper part of the main core. Shunt core 30 is fabricated from a stack of U-I laminations and has a geometric shape substantially similar to that of the main core. The stack height of the shunt core is dependent on the flux density capability of the bottlenecks. Since the method for constructing the shunt core is substantially similar to the method for fabricating the main core only the fabrication of the main core will be discussed hereinafter.

A pair of windings 12A and 12B hereinafter called controlled coils 12A and 12B are seated on the legs of the shunt core. Electrical conductors (not shown) are connected to the controlled coils. As will be discussed hereinafter control means are connected to the control coils via the electrical conductors. By activating the control means the reluctance of the shunt core 30 is regulated so as to increase or decrease the amount of flux which is channeled away from the main core.

Still referring to FIG. 1 shunt core 32 is connected to bottlenecks 26 and 28 respectively. The magnetic characteristics, size, shape, etc. of shunt core 32 is substantially identical to that of core 30. This being the case a full description of shunt core 32 will not be given. Suffice it to say that a pair of controlled coils, only one (20A) of which are shown, is seated on the legs of shunt core 32. The coils are of similar configuration as coil 12A and 12B. The relationship between the main magnetic core and the other previous enumerated magnetic elements (e.g. shunt cores with coil thereon, bottlenecks) are arranged so that they are symmetrical about the main core. With this symmetrical structure the operating characteristic of the transformer is significantly improved. Stated another way, the range of control for the regulated output is wider. This is due to the fact that magnetic leakage paths are increased from one-sided shunt cores to two sided shunt cores.

In order to bind the transformer together to form a uniform structure, fastening means 42, 44, 46 and 48 are fitted into entry holes. A plurality of threaded nuts (not shown) are attached to the ends of the fastening means. By torquing the fastening means or the threaded nuts the transformer is given structural integrity. Of course, it is within the skill of the art to use other types of fastening means without departing from the scope of this invention. Connected to the transformer are mounting brackets 14. These mounting brackets are used for mounting the transformer to a support frame. In an attempt to restrict the flow of magnetic flux to the magnetic structure of the transformer the mounting brackets are fabricated from nonmagnetic material.

Figure 3A:
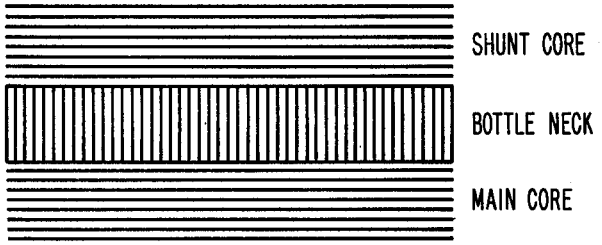
FIGS. 3A–3C show various geometric arrangements of the leakage path. Each of these geometric arrangements helps to improve the operating characteristic of the transformer.
Figure 3B:
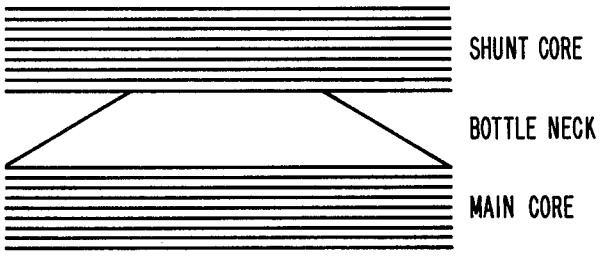
Figure 3C:
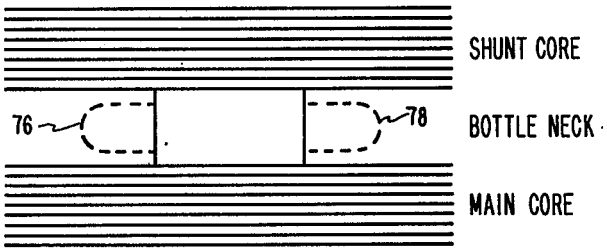

Referring to FIGS. 3A, 3B and 3C for a moment a plurality of side views showing the relationship and geometric arrangement between the main core, the shunt core and the bottlenecks are depicted. It is worthwhile noting that the drawings depict only one of the plurality of bottlenecks used in a transformer. However, the relationship between the main core and the shunt core which is demonstrated by the showing of one bottleneck is identical to the relationship which exists between the main core and the other bottlenecks. Although the laminations of the bottleneck may be arranged to be parallel to the laminations of the main core in the preferred embodiment of this invention it is determined that the operating characteristics of the transformer are significantly improved when the laminations forming the bottlenecks are arranged so as to be perpendicular to the laminations forming the main core and/or the shunt cores. This parallel perpendicular arrangement is demonstrated in FIG. 3A.

Although the reason for this improved performance is not fully understood it is believed that, as a result of the perpendicular arrangement, the effective air gap which is created when the laminations of the bottleneck are positioned perpendicular to the laminations of the main and/or shunt core is significantly reduced. With a reduction in the effective air gap the magnetomotive force which is necessary to drive magnetic flux across the air gap can be reduced. Similarly, if the magnetomotive force remains constant then more flux will be driven through the bottleneck and as a result regulation capability is improved.

FIG. 3B shows another geometric configuration of the bottleneck which improves the operating characteristics of the transformer. In this embodiment the bottleneck has a geometric shape which is substantially trapezoidal. In this configuration the widest section of the trapezoidal bottleneck is connected to the main core while the narrow section of the trapezoidal bottleneck is connected to the shunt core. Again, it is felt that by using a bottleneck which has a wide area of contact with the main core a higher concentration of flux is directed away from the main core and focused toward the shunt core as a result better operating characteristics are achieved.

Referring to FIG. 3C an alternative embodiment of the invention is shown. In this embodiment, of the invention, instead of placing control coils on the shunt cores the control coils, for example 76 and 78, are seated on the bottlenecks of the magnetic structure. In this embodiment of the invention the control coils on the bottlenecks perform the same function as when they are placed on the shunt cores, namely, to regulate the flow of flux from the main core. In this configuration the shunt core is merely acting as a return path for the flux from the main core.

Referring now to FIG. 2, a process for fabricating the transformer of FIG. 1 is shown. The process may be done automatically or manually. The partially completed transformer of FIG. 2 shows main magnetic core 16 with its associated coil, bottlenecks 22 and 24, and the partially completed shunt core 30 with its associated control coils 12A and 12B respectively. As was stated previously the bottlenecks and shunt cores with associated windings are positioned to be symmetrical on either side of the main core. This being the case only one half of the symmetrical components, namely bottlenecks, shunt core and associated coil will be discussed since the components and fabrication of the other symmetrical components are substantially identical to the discussed portion. Also, the laminations which are used to fabricate shunt core 30 are identical to the lamination used to fabricate main core 16. Therefore, only the fabrication of shunt core 30 will be discussed since main core 16 can be fabricated using the teaching for core 30. Depending on performance requirements, only the stack height of main core 16 and shunt core 30 will be different.

Still referring to FIG. 2 shunt core 30 is fabricated from a stack of U-I laminations 50 and 52 respectively. The U-lamination has a width W which may be any predetermined value. For example, in the preferred embodiment of the present invention W has a width of one inch. Each of the U-laminations is fabricated with access holes 54 and 56 respectively. These access holes are used for fastening the transformer to form a unified structure when it is assembled. Similarly, the I-lamination is fabricated with access holes 58 and 60. These access holes serve the same purpose as the access holes of the U-lamination. The I-lamination has a width K which is generally equivalent to the width of the U-lamination. However, it is within the skill of the art to fabricate the U-I laminations to have different widths.

In order to fabricate the shunt core and its associated coils, for example, coil 12A and 12B, the coils are laid side-by-side so that their longitudinal dimensions are in contact. Each coil includes a bobbin upon which the windings are wound. The coil has a predetermined number of turns which is dependent upon the power requirement, degree of control etc. of the transformer. It is worthwhile mentioning that the turns of the coil on the main core may affect the range over which the output current is controlled. With the coils laying on their sides a U-lamination, for example lamination 50, is positioned within the bobbin of the coils. Each leg of the U is positioned within either one of the coil bobbins with edge 62 abutting the ends of the coil. I-lamination 64 is then placed so as to abut legs 66 and 68 of the U-lamination. The I-lamination is positioned on the ends of the coil which is opposite to the closed portion of the U. This U-I lamination forms the first element in building the stack of lamination for the shunt and/or main core. With the first element laid a second element is placed upon the first. The second element includes a U-I lamination and is put together in a similar manner as the first element. However, the U-lamination is positioned in the bobbins of the coils so that the closed portion of the U lamination is on the side opposite to which the first U-lamination was placed. I-lamination 52 is then placed to abut the ends of the newly placed U-lamination. The laminations are placed so that their holes are in alignment to receive the fastening means. The process of alternating the U-I lamination continues until a stack having a predetermined height is fabricated. The transformer is then tied together by screws which are placed in the access holes. Of course it is within the skill of the art to use other methods to fabricate the transformer without departing from the scope of the present invention.

As was stated previously, the laminations forming the bottleneck may be arranged to run parallel to the laminations forming the main core and/or the shunt core. However, in the preferred embodiment of this invention, laminations in the bottleneck are arranged to run perpendicular to the laminations forming the main core and/or the shunt core.

To effectuate the perpendicular relationship between the bottleneck sections, the main core sections, and the shunt core sections of the transformer, two methods for orientating the laminations of the bottleneck are shown in FIGS. 1A and 1B. Of course, it is well within the skill of the art to orientate the laminations so as to obtain the perpendicular relationship without deviating from the scope of the present invention.

In the arrangement shown in FIG. 1B the laminations forming the bottlenecks are arranged in the so-called lengthwise orientation. In this orientation the bottlenecks are fabricated from I-laminations. The I-laminations are compiled to form a stack and the stack is fitted between the main core and the shunt core. As is evident from FIG. 2 the I-laminations have a substantially rectangular geometric shape and are positioned on edge between the main core and the shunt cores (FIG. 1B) so that the longest dimension of the rectangular bar I-laminations are in juxtaposition with the longest dimension of the I-laminations used to form the main and shunt cores.

In the arrangment shown in FIG. 1A the laminations forming the bottleneck are arranged in the so-called crosswise orientation. For this orientation the laminations have a substantially square geometric shape. The laminations are positioned on edge between the main core and the shunt core so that one dimension of the lamination turns crosswise to the longest dimension of the I-laminations used to form the main and shunt cores.

Although the operating output range of the flux regulated transformer is increased when a symmetrical structure of the present invention is used, it was determined that as the stack height of the main core increases to and beyond an optimum value, a non-symmetrical or symmetrical structure has a minimizing effect on the flux characteristic of the main core. For example, in FIG. 2, the non-symmetrical structure is comprised of main core 16 with bottlenecks 22 and 24. In this configuration as the stack height increases the flux from opposite side 70 of the transformer is decreasingly affected by the bottlenecks 22 and 24 or shunt core 30. It has been determined that there is an optimum stack height beyond which the effect of a non-symmetrical and symmetrically constructed transformer on the operating characteristics can be improved by increasing leg width W, and decreasing the stack height of the main core. It is therefore determined that there is a relationship between the width of the laminations and the optimum stack height. In the preferred embodiment of this invention it is determined that the maximum optimum stack height is approximately 2 and ½ times the leg width W of the laminations.

Figure 5:
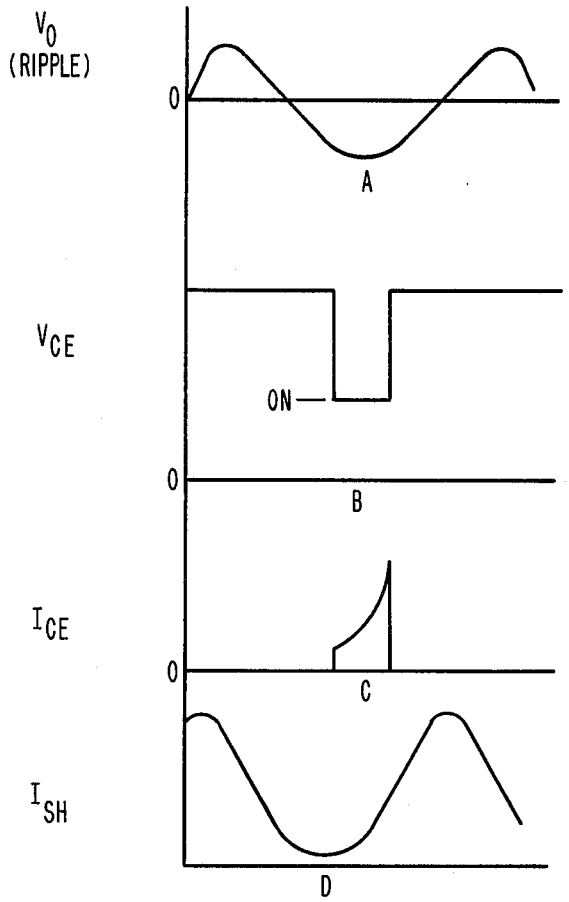
FIG. 5 shows graphs which are helpful in understanding the circuit of FIG. 6.
Figure 6:
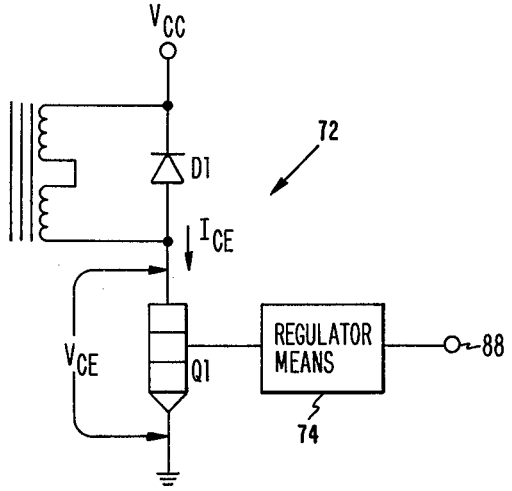
FIG. 6 shows the control circuitry which is positioned in the feed back loop of the transformer.

As was stated previously control means 72 is connected to the electrical conductors of the shunt coils (not shown) and the output of the transformer to generate controlled current for varying the magnetic characteristics of the bottleneck and/or the shunt cores. FIG. 6 depicts one of said control means, while FIG. 5 shows a graphic representation of the control means operation. Diode $D_1$ is positioned across the control coils of the shunt and/or bottleneck. The anode of the diode is connected to the collector of transistor $Q_1$ and the output of regulator means 74 is connected to the base of transistor $Q_1$. Power for the circuit means is supplied from power source $V_{cc}$. The power source may be a separate supply or it may be generated from a secondary coil seated on the main core of the transformer. The representative curves of current and voltage waveform are shown in FIG. 5. In operation the regulator means senses the output voltage which appears at terminal 88. This terminal is the output voltage of the transformer rectifier-filter circuit. The sensed voltage is compared with an internal referenced voltage of the regulator means. As the ripple of the output voltage ($V_o$) traverses below the internal referenced voltage, the regulator means turns on transistor $Q_1$ allowing current $I_{ce}$ (FIG. 5) to flow through the control windings. As the ripple exceeds the reference voltage the regulator means turns off $Q_1$. With $Q_1$ off diode $D_1$ begins to conduct and provides a conduction path for the decaying or induced current of the control windings until the cycle repeats itself. As is evident from FIG. 5, the voltage $V_{ce}$, across transistor $Q_1$, is on for a relatively short period of the total cycle. Alternately, transistor $Q_1$ is therefore on for a relatively short period of the total cycle. Since transistor $Q_1$ only conducts for a relatively short period of the total cycle heat generation is kept within acceptable limits. The shunt current ($I_{sh}$) which flows in the shunt core and/or coils is shown in FIG. 5.

The advantage of the regulating scheme is that transistor $Q_1$ has the effect of tickling the start of the flow of control current while it is in saturation. The remainder of the control current is then controlled by diode $D_1$ which also has a low conducting voltage. The net result is that typically less than 1% of the total output power is dissipated across the solid state devices and as previously stated this low power dissipation limits the quantity of generated heat.

Figure 4:
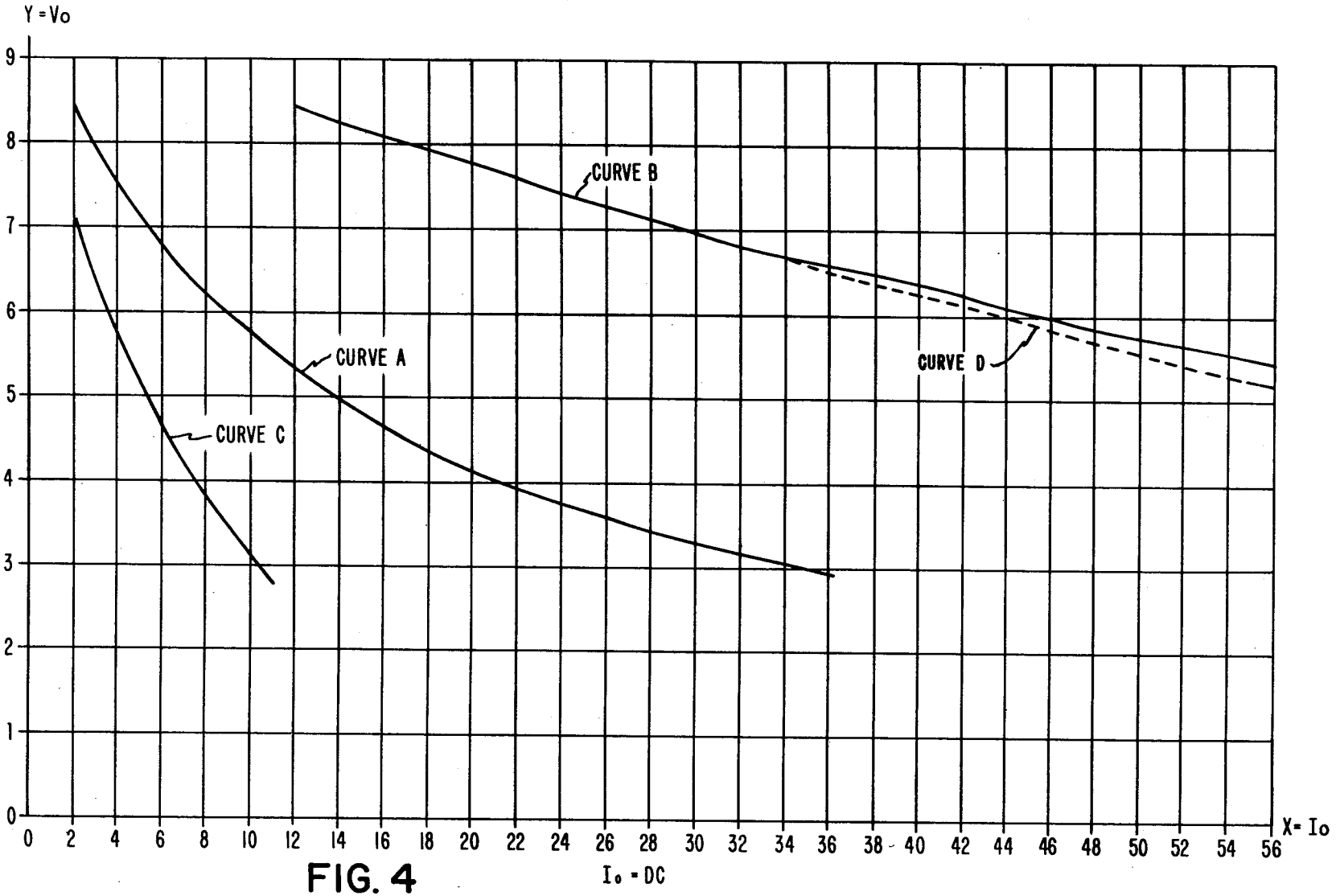
FIG. 4 depicts a family of curves which shows improved operating characteristics of the transformer.

Referring now to FIG. 4 a plot showing the operating characteristics of the symmetrical transformer is shown. Vertical axis Y represents DC output voltages ($V_o$). Likewise horizontal axis X represents DC current ($I_o$). Curve A represents the output characteristics of a non-symmetrical transformer, that is, a transformer having one shunt core connected by two bottlenecks to the main core. The input voltage to the transformer is line voltage which was approximately 205 volts AC. Of course other control means may be used for supplying an input voltage. The control current ($I_c$) was approximately equal to 0 amps.

Curve B depicts the operating characteristic curve for the same transformer. The line voltage was the same but the control current ($I_c$) was at a maximum level which saturates the shunt core. In the preferred embodiment of the invention $I_c$ was approximately 1.2 amps. The range of control is the area between curve A and curve B at a particular $V_o$. For example at a particular $V_o$ of 7 volts DC, the output current $I_o$ varies between 5.5 to 28 amps.

The ideal situation is to have a flux regulated transformer with a wide range of control. In other words, at a fixed output voltage the output current varies over a wide range. This range of control is significantly improved when the symmetrical shunt control transformer of the present invention is used. In other words a shunt core/bottleneck assembly is situated on either side of the main core. Curve C represents the operating characteristic curve of a symmetrical transformer with $I_c$ equal to 0 amps. Curve D represents the operating characteristic curve of the symmetrical transformer when the shunt is saturated with a control current approximately equal to 1.2 amps. As is evident from this curve the range control is significantly improved thereby fulfilling the primary aim of the symmetrical flux controlled transformer.

While the invention has been particularly shown and described with reference to a preferred embodiment thereof, it will be understood by those skilled in the art that various changes in form and details may be made therein without departing from the spirit and scope of the invention:

What is claimed is:

1. A regulating transformer comprising in combination:

a main core of essentially "O" shaped laminated construction for supporting primary and secondary coils;

a first and a second shunt core of essentially similarly shaped laminated construction to said main core, each supporting at least one control coil, one shunt core being positioned in spaced juxtaposed alignment on each side of said main core;

separate flux interconnecting means placed such that the magnetic flux from said main core travels at right angles to said flux interconnecting means for interconnecting said main core and both of said shunt cores, said flux interconnecting means including a plurality of laminations oriented in a perpendicular relationship to the laminations of said main core and said shunt cores and also being operable to mechanically couple said main and said shunt cores; and fastening means interconnecting said cores and said flux interconnecting means operable to provide structural strength to the transformer.

2. A regulating transformer as defined in claim 1 wherein said plurality of laminations of said flux interconnecting means comprise a substantially rectangular geometric shape positioned on edge between said main core and said shunt cores in a lengthwise orientation.

3. A regulating transformer as defined in claim 1 wherein said plurality of laminations of said flux interconnecting means are positioned on an edge between said main core and said shunt cores in a crosswise orientation.

4. A regulating transformer as defined in claim 1 wherein said flux interconnecting means has a substantially trapezoidal geometric shape.

5. A regulating transformer as defined in claim 1 wherein said main core comprises a plurality of U and I shaped laminations having a stack height of approximately two and one-half times the width of the laminations.

* * * * *